United States Patent [19]

Gapper

[11] 3,984,147

[45] Oct. 5, 1976

[54] MINING MACHINES WITH EXTENSIBLE PROBE ARM

[75] Inventor: Terence John Gapper, Duffield, England

[73] Assignee: Coal Industry (Patents) Limited, London, England

[22] Filed: May 20, 1975

[21] Appl. No.: 579,241

[30] Foreign Application Priority Data

May 21, 1974 United Kingdom ..... 22626/74

[52] U.S. Cl. ..... 299/1; 250/268; 324/10

[51] Int. Cl.[2] ..... E21C 27/24

[58] Field of Search ..... 299/1; 324/10; 250/268; 166/66, 113; 175/77

[56] References Cited

UNITED STATES PATENTS

| | | | |
|---|---|---|---|
| 2,326,827 | 8/1943 | Bynum | 175/77 |
| 3,719,394 | 3/1973 | Hartley | 299/1 |
| 3,817,578 | 6/1974 | Wilson | 299/1 |

FOREIGN PATENTS OR APPLICATIONS

| | | | |
|---|---|---|---|
| 1,142,022 | 2/1969 | United Kingdom | 299/1 |

*Primary Examiner*—Ernest R. Purser

*Attorney, Agent, or Firm*—Stevens, Davis, Miller & Mosher

[57] ABSTRACT

A cutting horizon sensing probe of a ranging drum shearer mining machine is mounted on a telescopic arm pivotally supported on the body of the machine such that when it is desired to move the probe into its operational position the arm is first extended from its non-operational position to an intermediate position and is then pivoted towards its operational position.

16 Claims, 5 Drawing Figures

MINING MACHINES WITH EXTENSIBLE PROBE ARM

This invention relates to mining machines including cutters and apparatus for steering the cutting horizons of the cutters.

In particular, although not exclusively, the invention relates to a mining machine including a boom mounted cutter which can be ranged up or down relative to the machine body.

It has been proposed to provide a mining machine with apparatus for steering the machine including a combined electromagnetic-radiation emitter and detector probe carried on a fixed length arm pivoted to the machine body and for a hydraulic ram acting on the arm to urge the probe into contact with the mine roof. Such a prior known arrangement tends to be suitable only when the mine roof is formed adjacent to the machine body and the arm can be maintained relatively short. With a machine having a ranging cutter the mine roof tends to be more remote from the machine body and if the prior proposed arrangement were adopted it would be necessary to have a relatively long arm which when not in its operating position would have to be accommodated in a zone where only restricted space usually is available and where it would be likely to be damaged or difficult to operate.

An object of the present invention is to provide a mining machine including apparatus which overcomes or reduces the above mentioned problems.

According to the present invention a mining machine comprises a body, a support member associated with the body for supporting a cutter, a probe for sensing a cutting horizon of the cutter, a telescopic arm pivotally mountable on the body for supporting the probe, means for extending the arm from a non-operative position towards an intermediate position and for pivoting the arm relative to the body from the intermediate position towards an operative position.

Preferably, the said means comprises a first ram for extending the arm and a second ram for pivoting the arm.

Advantageously, the said means includes control valve means for controlling the action of the first and second rams.

Conveniently, the control valve means comprises a valve assembly arranged to detect when the telescopic arm is fully extended from the non-operative position into the intermediate position and to inititate action of the second ram to pivot the arm towards the operative position when the arm is fully extended.

Preferably, the valve assembly is arranged to detect when the arm has pivoted from the operative position into the intermediate position and to initiate action of the first ram to retract the arm towards its non-operative position.

Preferably, means are provided to sense the extension of the second ram and to derive a signal indicative of the second ram extension.

Advantageously, the said means comprises a linear potentiometer.

Conveniently, the arm houses a dividing framework which defines compartments within the arm.

Advantageously, the first ram is positioned within one of the compartments.

Preferably, another of said compartments houses elongated flexible members adapted to interconnect the probe with control means on the machine body.

By way of example only, one embodiment of the present invention will be described with reference to the drawings accompanying the Provisional Specification in which.

Figure 1:
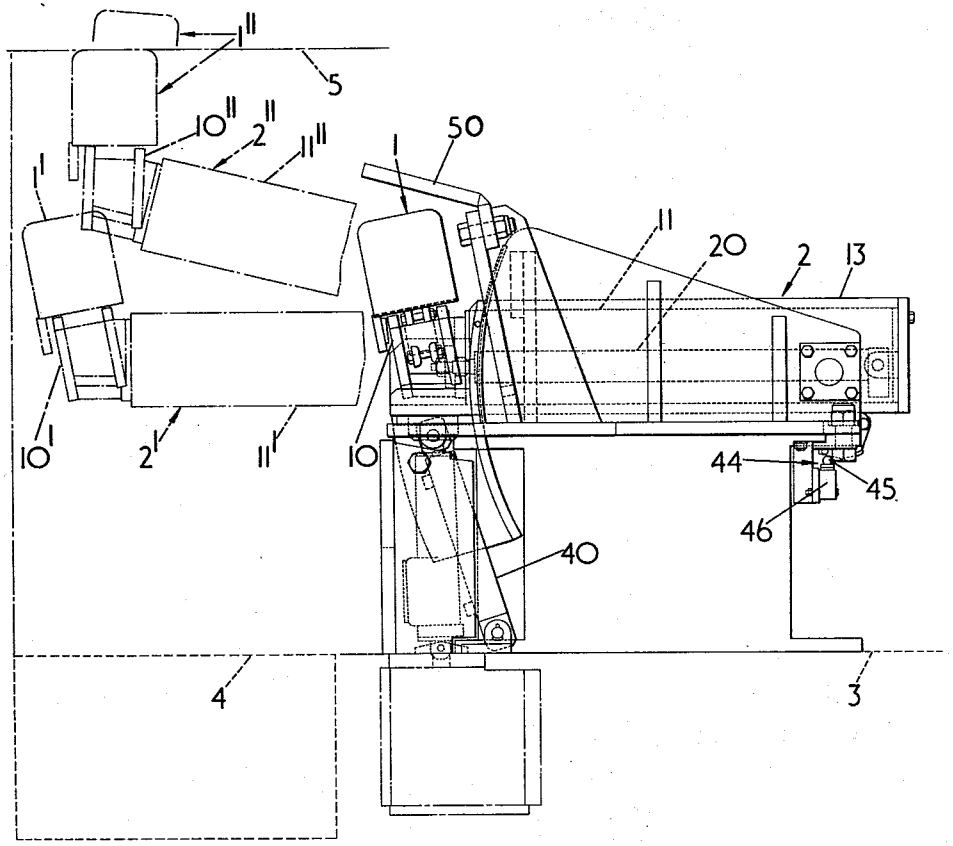
FIG. 1 is a front view of apparatus for steering a longwall face mineral mining machine a part of the outline of which is shown, part of the apparatus being shown in several operational positions.
Figure 2:
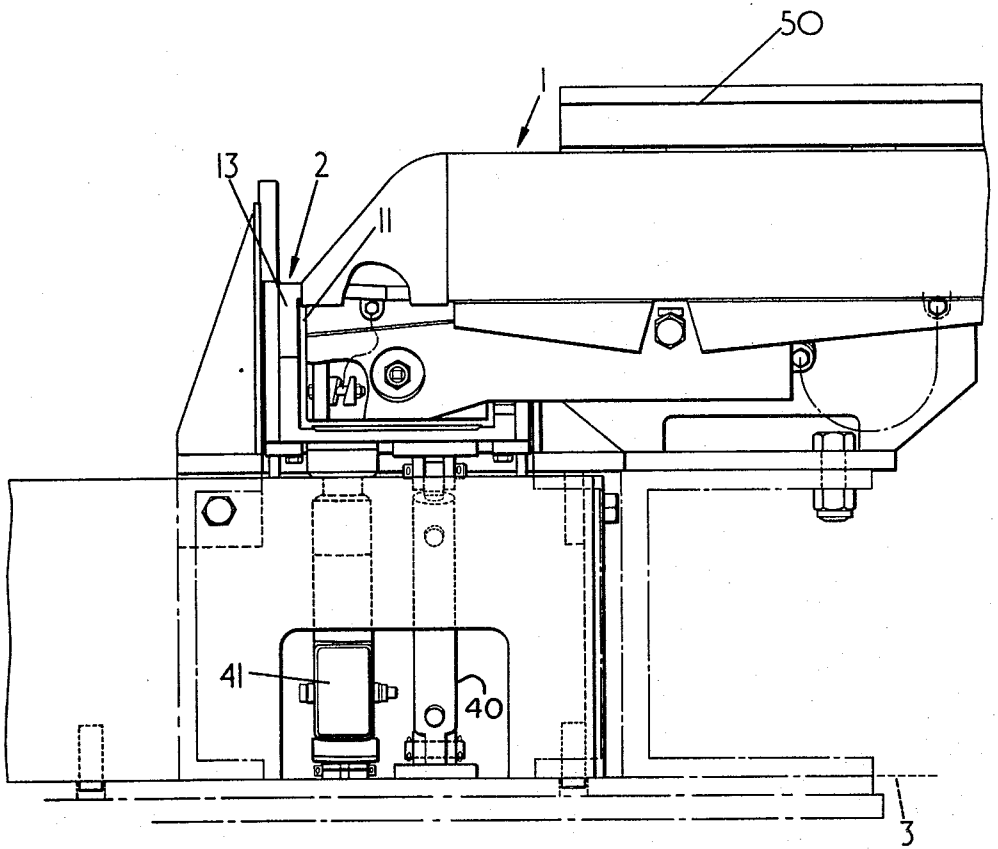
FIG. 2 is an incomplete side view of the apparatus of FIG. 1.
Figure 3:
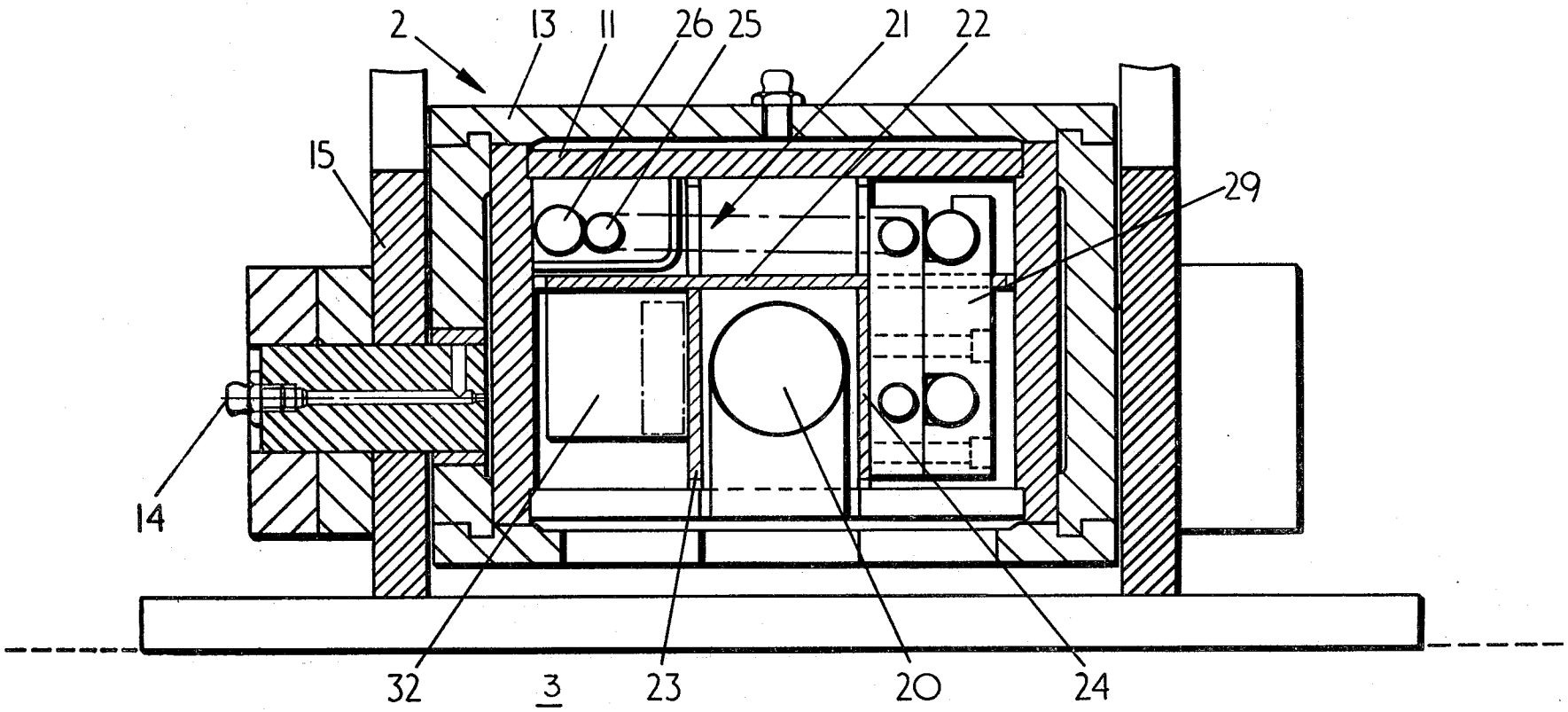
FIG. 3 is a section through a detail of the apparatus of FIG. 1.
Figure 4:
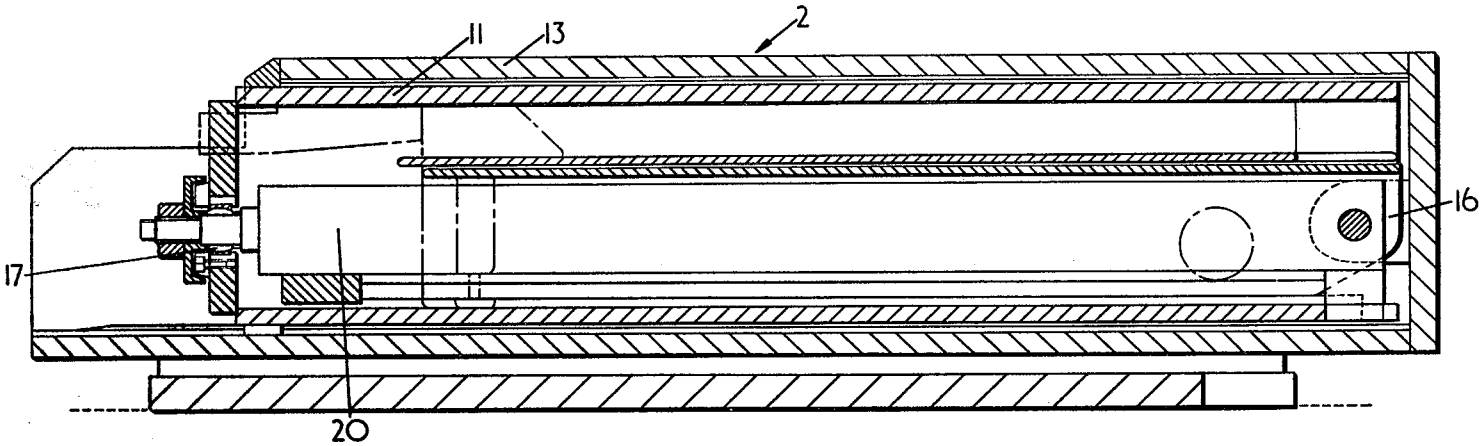
FIG. 4 is a side view of the detail of FIG. 3.
Figure 5:
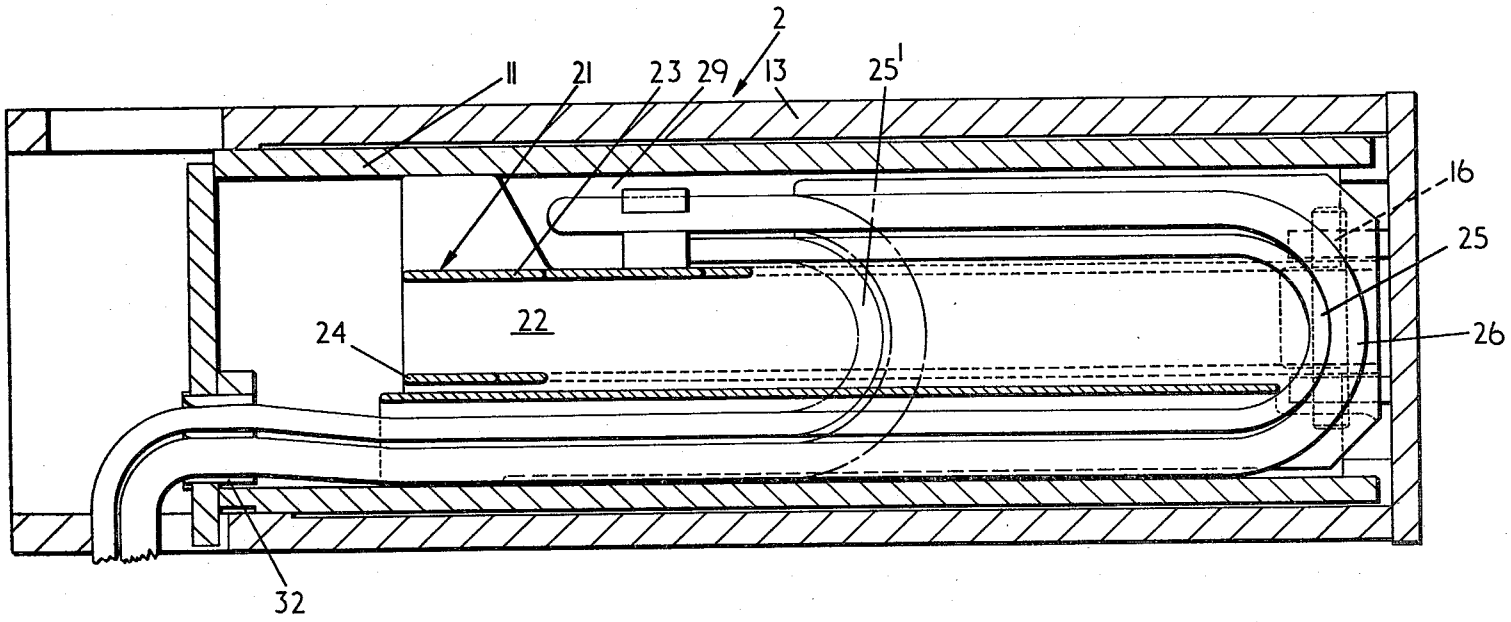
FIG. 5 is a sectional plan of the detail of FIG. 3.

The apparatus shown in the drawings include a combined electro-magnetic radiation emitter and detector probe 1 carried on a telescopic arm 2 pivotally mounted onto the body (the adjacent outline of which is indicated by 3) of a ranging drum shearer type coal mining machine which in use traverses to and fro along an armoured face conveyor (not shown) extending along a longwall face and which has a rotary cutter drum (indicated by broken lines 4) carried on a support member constituted by a boom (not shown) pivotally mounted on the machine body. In operation the cutting horizon of the cutter drum is controlled to steer the machine by pivotal adjustments to the boom in response to several sensed parameters including that sensed by the combined electromagnetic emitter and detection probe 1 i.e. the thickness of a band of roof coal left by the cutter drum adjacent the upper rock boundary. The thickness of the coal band is sensed by detecting the amount of backscattered radiation arising from the electro-magnetic radiation emitted from the emitter included in the probe 1. Other parameters which are sensed to steer the machine include the inclination of the machine relative to the inclination of the mineral seam, in directions along the face and transverse the face, the height of the cutter drum relative to the conveyor and the height of the mine roof relative to the machine body. Signals indicative of all these sensed parameters are fed to control means mounted on the machine body which accordingly steer the cutter drum along a desired cutting horizon.

The mining machine in the drawings is sensing the thickness of the coal band adjacent to the mine roof 5 formed by the cutter drum during its previous traverse along the face and steering the cutter drum as it forms the mine floor on its present traverse.

The probe 1 is supported in a bracket assembly 10 which permits limited swivel movement of the probe relative to the arm 2 to enable the probe to negotiate undulations in the mine roof and which is fixedly mounted on an inner member 11 of the telescopic arm. The inner member 11 is slidably supported in an outer member 13 for movement longitudinally of the outer member which is pivotably mounted about a horizontal axis 14 in a mounting bracket 15 secured to the machine body 3 for pivotal movement relative to the machine body 3.

Movement of the inner member 11 longitudinally of the outer member 13 is controlled by a hydraulic ram 20 which is connected to the outer member by a pivot mounting 16 and to the inner member by a spherical bearing 17 and which is housed within one compartment formed by a dividing framework 21 loosely fitted within the inner member 11. The dividing framework includes a horizontal deck plate 22 and two vertical plates 23 and 24 the upper portions of which extend only partway along the inner member 11 to permit a hydraulic hose 25 and an electric cable 26 to slide along the deck plate 22 as the inner member moves lonitudinally of the outer member. The hose 25 feeds hydraulic fluid from an inlet block 29 fed from the machine body to the probe 1 for actuating a mechanism (not shown) which moves the electromagnetic radiation emitter into its operating position i.e. into a position where it emits radiation from the probe 1. When hydraulic pressure is exhausted from the hose 25 the emitter automatically moves into a disarmed position where no radiation is emitted from the probe. The ends of the hose 25 are fixedly secured to the outer member 13 by the inlet block 29 and to the inner member 11 by a clamp 32 so that as the arm extends from its fully retracted position to its fully extended position the hose slides along the deck plate 22 from a position indicated by 25 to a position indicated by 25$^1$. When the arm is retracted again the hose slides along the deck plate to the position indicated by 25.

The electric cable 26 feeds signals from the probe to the control means on the machine body and is fixedly secured to the inner and outer members 11 and 13 in a similar manner to the hose 25 by the clamp 32 and the inlet block 29, respectively, the cable being continuous and passing through a passage in the inlet block.

Pivotal movement of the arm 2 about the mounting bracket 15 is controlled by a ram 40 pivotally connected between the machine body 3 and the outer member 13. A linear potentiometer 41 is provided adjacent to the ram 40 to sense the extension of the ram and to feed a signal indicative of the ram extension to the control means for steering the machine, the ram extension being a direct indication of the height of the mine roof relative to the machine body i.e. one of the previously stated parameters required to be known to steer the machine along its desired path.

Actuation of the rams 20 and 40 are controlled by two control valve assemblies 44 (only one of which is shown in FIG. 1) located adjacent to the ends of the outer member 13 respectively. The valve assembly 44 comprises a plunger 45 which is depressed into the valve block 46 by the outer member 13 when the arm 2 is in its fully lowered position, Depression of the plunger 45 feeds pressure fluid to the ram 20 to retract the ram. The other control valve assembly is mounted on the outer member 13 and comprises a plunger which is depressed by an abutment (not shown) provided on the inner member when the inner member is fully extended. Depression of this plunger feeds pressure fluid to the ram 40 to raise the arm and urge the probe 1 into contact with the mine roof.

A guard 50 is provided on the machine body to protect the apparatus against falling rock and a layer of spongy material is placed beneath the arm 2 to help prevent broken rock material from lodging beneath the raised arm so as to prevent lowering of the arm.

In use when it is desired to sense the mine roof, an operator actuates a control valve (not shown) to feed pressure fluid to actuate the ram 20 to extend the arm from its non-operating position 2 where the probe 1 is adjacent to the machine body towards an intermediate position (indicated in FIG. 1 by 2$^1$, 1$^1$) when the arm is fully extended. The abutment on the moving inner member 11 depresses the plunger of the associated valve assembly to feed pressure fluid to actuate the ram 40 to raise the fully extended arm about the pivotal mounting bracket 15 into its operative position 2$^{11}$ where the probe 1$^{11}$ is urged into contact with the mine roof. Pressure fluid fed along the hose 25 moves the emitter from the disarmed position and signals indicative of the thickness of the band of roof coal are fed along the cable 26 to the steering control means. A signal indicative of the height of the cutter drum relative to the machine body is fed from the linear potentiometer to the steering control means.

When the machine reaches the end of its traverse along the face the operator actuates the previously mentioned control valve to feed pressure fluid to the ram 40 which pivots the fully extended arm about the pivotal mounting bracket 15 to lower the probe 1$^{11}$ from the mine roof 5. Before the probe 1$^{11}$ disengages the mine roof pressure fluid is exhausted from the hose 25 so that the emitter is moved into its disarmed position. The ram 40 lowers the arm until it reaches the intermediate position 2$^1$ where the plunger 45 is depressed into the valve assembly 45 by the outer member 13 to actuate the ram 20 and the arm is retracted into its non-operative position 2 with the probe 1 adjacent to the machine body and protected by the guard 50.

Once the probe 1 is in its non-operative position the cutter drum may be raised or lowered as desired and the machine can move along the conveyor without fear of damaging the probe due to falling rock or collision with other mine equipment as for example roof support beams extending over the machine body.

When it is required to sense the mine roof the control valve is actuated by the operator and the above procedure repeated.

From the above description it can be seen that the present invention provides an arm which is relatively short when in its non-operating position but which is capable of supporting the probe in its operative position remote from the machine body.

I claim:

1. A mining machine comprising a body, a support member associated with the body for supporting a cutter, a probe for sensing a cutting horizon of the cutter, a telescopic arm pivotally mounted on the body for supporting the probe, means for extending the arm from a protected non-operative position laterally towards an intermediate position and for pivoting the arm relative to the body from the intermediate position towards an operative position.

2. A machine as claimed in claim 1, in which the said means comprises a first ram for extending the telescopic arm and a second ram for pivoting the telescopic arm.

3. A machine as claimed in claim 2, in which the said means includes central valve means for controlling the action of the first and second rams.

4. A machine as claimed in claim 3, in which the control valve means comprises a valve assembly arranged to detect when the telescopic arm is fully extended from the non-operative position into the intermediate position and to initiate action of the second ram to pivot the arm towards the operative position when the arm is fully extended.

5. A machine as claimed in claim 4, in which the valve assembly is arranged to detect when the arm has pivoted from the operative position into the intermediate position and to initiate action of the first ram to retract the arm towards its non-operative position.

6. A machine as claimed in claim 5, in which sensor means are provided to sense the extension of the seond ram and to derive a signal indicative of the second ram extension.

7. A machine as claimed in claim 6, in which sensor means comprises a linear potentiometer.

8. A machine as claimed in claim 7, in which the arm houses a dividing framework which defines compartments within the arm.

9. The machine as claimed in claim 8, in which the first ram is positioned within one of the compartments.

10. A machine as claimed in claim 9, in which another of said compartments houses elongated flexible members adapted to interconnect the probe with control means on the machine body.

11. A mineral mining machine comprising:

a body;

a pivotally mounted support member associated with the body for supporting a ranging cutter drum;

a probe for sensing a cutting horizon of the cutter drum;

a pivotally mounted arm supporting the probe for movement from a non-operative protected position adjacent the body to an operative position adjacent a mineral seam;

means for extending the arm from the non-operative protected position laterally toward the mineral seam and into a non-operative intermediate position adjacent the cutter drum but remote from the direction of travel of the cutter drum; and means for pivoting the arm relative to the body from the non-operative intermediate position towards an operative position adjacent a band of mineral left by the cutter drum and distant from the body, whereby the probe can sense the thickness of the band of mineral left by the cutter drum so as to facilitate the steering of the machine by pivotal adjustments to the support member during the winning of a strip of mineral and the probe can be withdrawn into the non-operative protected position at all other times.

12. The machine of claim 11 in which the arm is telescopic.

13. The machine of claim 11 in which the arm is mounted for two separate movements so that the lateral movement is completed before the pivotal movement begins.

14. A mineral mining machine comprising:

a body;

a support member associated with the body for supporting a cutter;

a probe for sensing a cutting horizon of the cutter;

a pivotally mounted arm supporting the probe for movement from a non-operative protected position adjacent the body to an operative position adjacent a mineral seam;

means for extending the arm from the non-operative protected position laterally toward the mineral seam and into a non-operative intermediate position adjacent the cutter but remote from the cutter direction of travel; and means for pivoting the arm relative to the body from the non-operative intermediate position to an operative position adjacent a band of mineral left by the cutter and distant from the body, whereby the probe can sense the thickness of the band of mineral left by the cutter so as to facilitate the steering of the machine during the winning of a strip of mineral and the probe can be withdrawn into the non-operative position at all other times.

15. The machine of claim 14 in which the arm is telescopic.

16. The machine of claim 14 in which the arm is mounted for two separate movements so that the lateral movement is completed before the pivotal movement begins.

* * * * *